US005884131A

United States Patent [19]

Shimizu et al.

[11] Patent Number: 5,884,131

[45] Date of Patent: Mar. 16, 1999

[54] DEVELOPING DEVICE WHICH ACCOMPLISHES DEVELOPMENT USING THE ACTION OF AN ALTERNATING CURRENT FIELD BETWEEN A DEVELOPER-CARRYING MEMBER AND AN IMAGE-CARRYING MEMBER

[75] Inventors: Tamotsu Shimizu, Settsu; Yoshiyuki Iguchi, Takarazuka; Yoshio Sakagawa, Ibaraki, all of Japan

[73] Assignee: Minolta Co., Ltd., Osaka, Japan

[21] Appl. No.: 25,145

[22] Filed: Feb. 18, 1998

[30] Foreign Application Priority Data

Feb. 20, 1997 [JP] Japan ..... 9-035431

[51] Int. Cl.[6] ..... G03G 15/08

[52] U.S. Cl. ..... 399/270; 399/285

[58] Field of Search ..... 399/270, 285, 399/55, 289

[56] References Cited

U.S. PATENT DOCUMENTS

| | | | |
|---|---|---|---|
| 4,610,531 | 9/1986 | Hayashi et al. . | |
| 5,424,812 | 6/1995 | Kemmochi et al. | 399/270 |
| 5,534,982 | 7/1996 | Sakaizawa et al. | 399/270 |
| 5,610,696 | 3/1997 | Kemmochi et al. | 399/285 |
| 5,669,050 | 9/1997 | Sakemi et al. | 399/270 |
| 5,678,130 | 10/1997 | Enomoto et al. | 399/55 |

*Primary Examiner*—S. Lee

*Attorney, Agent, or Firm*—Burns, Doane, Swecker & Mathis, LLP

[57] ABSTRACT

A developing device capable stable production of halftone image having excellent texture while maintaining suitable image density by utilizing an AC electric field between a developer-carrying member and an image-carrying member and providing a rest period wherein the AC electric field is not active so as to develop electrostatic latent image formed on the image carrying member.

15 Claims, 4 Drawing Sheets

DEVELOPING DEVICE WHICH ACCOMPLISHES DEVELOPMENT USING THE ACTION OF AN ALTERNATING CURRENT FIELD BETWEEN A DEVELOPER-CARRYING MEMBER AND AN IMAGE-CARRYING MEMBER

This application is based on application No. 9-35431 filed in Japan, the content of which is hereby incorporated by reference.

BACKGROUND OF THE INVENTION

1. Field of the Invention

The present invention relates to a developing device which develops an electrostatic latent image formed on an image-carrying member such as a photosensitive member or the like in an image forming apparatus such as a copier, printer and the like, and more specifically relates to a developing device of a type which transports developer via a developer-carrying member such as a developing sleeve disposed opposite an image-carrying member to develop said latent image utilizing the action of an alternating current field between a developer-carrying member and an image-carrying member.

2. Description of the Related Art

In conventional image forming apparatus such as copiers and printers, various developing devices are used to develop an electrostatic latent image formed on an image-carrying member such as a photosensitive member and the like.

One example of such a developing device is the device shown in FIG. 6. In this device, a device body 110 provided with a cylindrical developer-carrying member 111 which has an internal magnet roller 111*a* is disposed opposite a rotatable image-carrying member 101, such that developer 102 accommodated within said body 110 is supplied to the surface of said developer-carrying member 111 via a developer supplying member 112 such as a bucket roller or the like. Developer 102 is maintained on the surface of said developer-carrying member 111 via the magnetic force of magnet roller 111*a*, and in this state developer 102 is transported in the direction of the image-carrying member (i.e., in the arrow direction in the drawing) via the rotation of said developer-carrying member 111. The developer 102 maintained on the surface of developer-carrying member 111 is regulated at a uniform amount by regulating member 113, and subsequently transported to a developing region at which said developer-carrying member 111 confronts said image-carrying member 101 so as to develop an electrostatic latent image formed on the surface of said image-carrying member 101.

In the aforesaid developing device, in order to efficiently develop the electrostatic latent image formed on the surface of said image-carrying member and prevent disruption of a toner image formed on the surface of said image-carrying member 101 via the action of a magnetic brush formed by said developer 102, a direct current (DC) voltage from DC power source 114 and an alternating current (AC) voltage from AC power source 115 are overlaid and supplied to the developer-carrying member 111 so as to accomplish development via the action of the electric field generated by the overlaid AC field on the DC field in the developing region at which said developer-carrying member 111 confronts said image-carrying member 101.

When developing halftone images via the action of the electric field generated by the overlaid AC field on the DC field in the developing region at which said developer-carrying member 111 confronts said image-carrying member 101, disadvantages arise insofar as there is marked fluctuation in image density in relation to the change in surface potential in the region of surface potential of image-carrying member 101 corresponding to the halftone image, which precludes obtaining excellent halftone images and adversely affects the texture of the produced image.

Therefore, in recent years, it has been proposed to alternately repeat a first cycle (action period) to form an alternating current electric field between a developer-carrying member and an image-carrying member, and a second cycle (rest period) to halt the formation of said alternating current electric field, as disclosed in U.S. Pat. No. 4,610,531. According to the method disclosed in the aforesaid United States Patent, the final component of the alternating current electric field in the first cycle becomes an electric field component which normally pulls back the developer from the image-carrying member to the developer-carrying member.

When, however, a pair of AC electric fields are used which have inverse field directions such that the final component of an AC field normally becomes a field component which pulls back developer from an image-carrying member to a developer-carrying member as in the method disclosed in the aforesaid United States Patent, the AC field is typically at rest in a state wherein developer is pulled back from the image-carrying member to the developer-carrying member when said AC field enters the second cycle. Therefore, in the second cycle, developer is pulled back to the developer-carrying member, and as a result when the next AC field is used to accomplish development, disadvantages arise insofar as the developer is not adequately supplied from the developer-carrying member to the image-carrying member, thereby reducing the image density of the formed image. Furthermore, the texture of the formed image cannot be sufficiently improved.

SUMMARY OF THE INVENTION

An object of the present invention is to provide an improved developing device capable of eliminating the previously mentioned disadvantages.

Another object of the present invention is to provide a developing device which develops by utilizing an AC electric field between a developer-carrying member and an image-carrying member and which produces excellent halftone images by providing a rest period wherein said AC electric field is not utilized, said developing device being capable stable production of images having excellent texture while maintaining suitable image density.

The aforesaid objects are attained by providing a developing device which develops electrostatic latent images formed on a rotatable image-carrying member, said developing device comprising:

a rotatable developer-carrying member disposed opposite said image-carrying member, wherein developer is transported via the rotation of said developer-carrying member to a developing region at which said developer carrying member confronts said image-carrying member; and a voltage supplying unit capable of supplying or not supplying an alternating current voltage to said developer-carrying member by alternatingly repeating an action period wherein an alternating current field is supplied and a rest period wherein an alternating current field is not supplied between said developer-carrying member and said image-carrying member;

wherein the following conditions are satisfied.

$$5\times10^3 \leqq \theta\times(Vpp/Ds)\times T\times N$$

and $5 \geqq Vpp/Ds$ where θ represents the circumferential speed ratio of the developer-carrying member relative to the image-carrying member;

Ds (mm) represents the space between the developer-carrying member and the image-carrying member in the developing region;

Vpp (kV) represents the peak-to-peak value of the AC voltage supplied to the developer-carrying member;

T (ms) represents the cycle of the AC voltage; and

N (revolutions per second) represents the number of rest periods of the AC voltage per second.

The developing device of the present invention develops images by alternatingly repeating an action period wherein an AC electric field is generated between a developer-carrying member and an image-carrying member, and a rest period wherein said AC electric field is not generated so as to satisfy the aforesaid conditions, and thereby provide excellent reproducibility of halftone images, assure suitable image density, and produce images having excellent texture.

When developing is accomplished by alternatingly repeating an action period wherein an AC electric field is generated between a developer-carrying member and an image-carrying member, and a rest period wherein said AC electric field is not so generated, toner in the developer moves reciprocatingly between the developer-carrying member and the image-carrying member during the action period under the influence of the AC field, such that said reciprocatingly moving toner impinges other toner as well as carrier contained in the developer so as to cause some dispersion. Although there is not reciprocating movement of toner induced by the AC field during the rest period following the action period, moving toner does impinge other toner as well as the carrier in the developer so as to cause broad dispersion. As this action is repeated, toner is dispersed in a wide range in the developing region, and this toner dispersed over a wide range is supplied to the image-carrying member so as to produce images having excellent texture while maintaining suitable image density.

The toner dispersion in the developing region is affected by the toner kinetic energy and the number of the aforesaid rest periods while developing, such that toner is sufficiently dispersed over a broad range as the toner kinetic energy increases, and as the number of rest periods increases. On the other hand, the toner kinetic energy increases pursuant with the increasing rotational speed of the developer-carrying member, and increases in conjunction with a stronger AC electric field generated between the developer-carrying member and the image-carrying member.

Therefore, when developing is accomplished so as to satisfy the previously mentioned conditions as in the developing device of the present invention, images having excellent texture are produced while assuring suitable image density by increasing the kinetic energy of the toner and increasing the number of rest periods during developing so as to produce toner dispersion over a broad range.

It is desirable that the action period be set so as to be longer than the rest period so as to allow the majority of the toner to attain sufficient kinetic energy prior to entering the rest period. It is particularly desirable that the action period of the electric field is increased prior to entering the rest period so as to apply the AC voltage for one cycle longer than the rest period to allow the toner to attain sufficient kinetic energy via the action of the electric field prior to entering the rest period.

In the aforesaid developing device, the amount of developer transported to the developing region by the developer-carrying member is desirably 0.5~10 mg/cm$^2$, and more desirably 1~7 mg/cm$^2$. When the amount of transported developer is less than 0.5 mg/cm$^2$, toner is inadequately supplied to the developer-carrying member and image density readily decreases. When the amount of transported developer exceeds 10 mg/cm$^2$, the thickness of the toner layer on the developer-carrying member increases so as to produce a residual counter charge on the carrier after developing which readily causes carrier adhesion on the image-carrying member.

Although a monocomponent developer comprising a toner and a two-component developer comprising a carrier and a toner may be used as the developer in the aforesaid developing device, use of a two-component developer is desirable. From the perspective of preventing irregular density and carrier adhesion, use of a carrier having a volume-average particle size of 20~50 μm is desirable, and a volume-average particle size of 25~45 μm is more desirable. Binder type carriers comprising fine magnetic powder dispersed in a binder resin, and coated type carriers comprising magnetic particles the surface of which is coated with resin are suitable for use as the aforesaid carrier. The toner used will desirably have a volume-average particle size of 3~12 μm, and will more desirably have a volume-average particle size of 4~9 μm. The weight ratio of the toner and carrier mixture is desirably in a range of 8~25 percent-by-weight (hereinafter referred to as "wt %"), and more desirably in a range of 10~20 wt %.

BRIEF DESCRIPTION OF THE DRAWINGS

These and other objects and features of the present invention will become clear from the following description taken in conjunction with the preferred embodiments thereof with reference to the accompanying drawings in which.

DETAILED DESCRIPTION OF THE PREFERRED EMBODIMENTS

The preferred embodiments of the present invention are described hereinafter with reference to the accompanying drawings.

Figure 1:
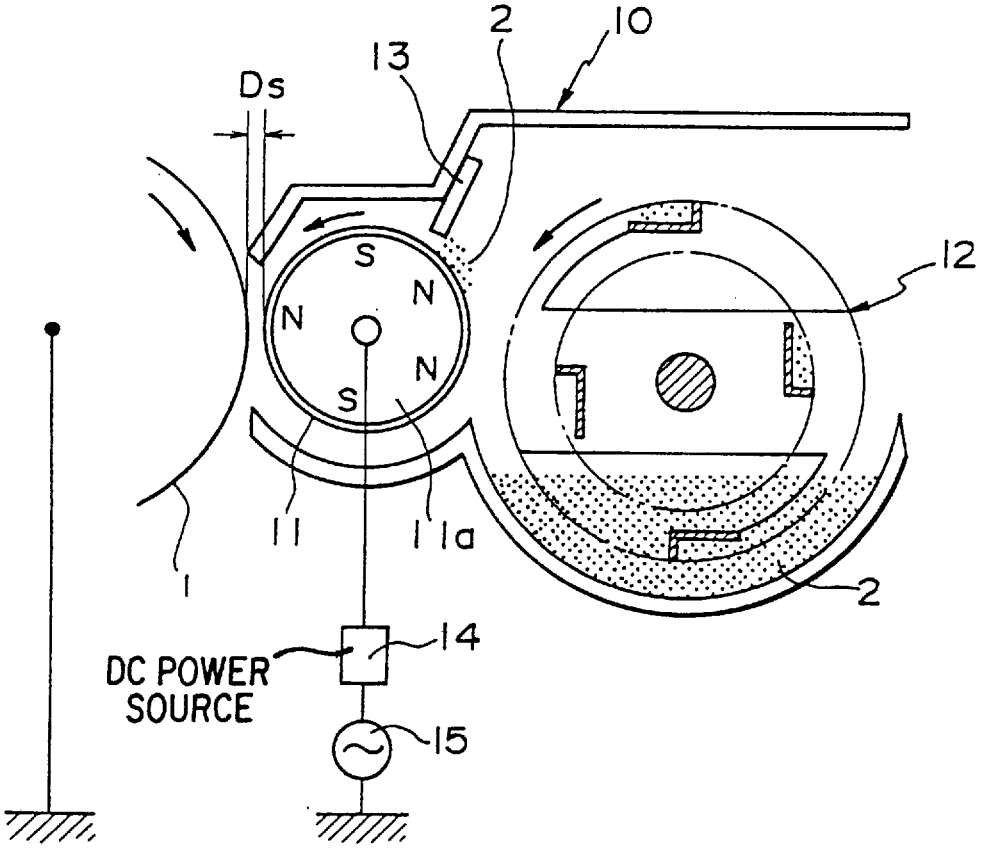
FIG. 1 briefly shows the construction of an embodiment of the developing device of the present invention.

FIG. 1 briefly shows the construction of a first embodiment of the developing device of the present invention.

The housing 10 of this developing device is provided with a developer-carrying member 11 confronting an image-carrying member 1 on the surface of which is formed an electrostatic latent image via a well-known process. Developer-carrying member 11 is cylindrical in shape and is provided with a built in internal magnet roller 11*a*. Developer 2 accommodated within housing 10 is supplied to the surface of said developer-carrying member 11 via a developer-supplying member 12 such as a bucket roller or the like.

The developer 2 which is supplied as described above is maintained on the surface of developer-carrying member 11 via the magnetic force of magnet roller 11*a*, and is transported via the rotation of said developer-carrying member 11. After the developer 2 transported via developer-carrying member 11 is regulated to a uniform amount by the regulating member 13, said developer 2 is delivered to the developing region at which developer-carrying member 11 confronts the image-carrying member 1, and the toner contained in said developer 2 is supplied to the electrostatic latent image formed on the surface of image-carrying member 1 so as to develop said latent image as a toner image.

This developing device supplies a voltage comprising an AC voltage from AC power source 15 overlaid on a DC voltage supplied from DC power source 14 to the developer-carrying member 11. Developing is accomplished, therefore, via the action of an electric field generated by the overlaid AC field on the DC field in the developing region wherein developer-carrying member 11 confronts image-carrying member 1.

In the developing device of the present embodiment, an action period wherein an AC field is utilized and a rest period wherein said AC field is not utilized are alternatingly repeated when a voltage comprising an AC voltage from an AC power source 15 overlaid on a DC voltage from a DC power source 14 is supplied to the developer-carrying member 11 so as to generate an electric field comprising an AC field overlaid on a DC field in a developing region in which the developer-carrying member 11 confronts the image-carrying member 1.

In the developing device of the present embodiment, when the circumferential speed ratio of the developer-carrying member 11 relative to the image-carrying member 1 is designated θ, the spacing between the image-carrying member 1 and the developer-carrying member 11 in the developing region is designated Ds (mm), the peak-to-peak voltage of the AC voltage applied to the developer-carrying member 11 is designated Vpp (kV), the period of the AC voltage is designated T (ms), and the number of rest periods per second is designated N (number periods per second), developing is accomplished so as to satisfy the following conditions.

$$5\times10^3 \leqq \theta\times(Vpp/Ds)\times T\times N$$

and $5 \geqq Vpp/Ds$

Then, tests were performed using a developer comprising a binder type carrier having a mean particle size of 35 μm and a toner having a mean particle size of 8 μm mixed so as to achieve a toner density of 13 wt % in a modified commercial copier (model Di30; Minolta Co., Ltd.), and from these test results it is clear that images having excellent texture are obtained when the previously mentioned conditions are satisfied.

EXAMPLE 1

In the first example, reverse development was accomplished with the system speed of the aforesaid copier set at 165 mm/s, the amount of developer 2 transported to the developing region by the developer-carrying member 11 set at 4.7 mg/cm$^2$, the initial surface potential V0 of the image-carrying member 1 set at −450 V, and the potential Vi of the exposed portion of the image-carrying member 1 set at −100 V.

In this example, experiments were conducted with the spacing Ds between the image-carrying member 1 and the developer-carrying member 11 in the developing region set variously at 0.3 mm and 0.5 mm, and the circumferential speed ratio θ of the developer-carrying member 11 relative to the image-carrying member 1 set variously at 1, 2, or 3. The AC voltage supplied to the developer-carrying member 11 from the AC power source 15 was an AC pulse voltage having a frequency of 3 kHz and a period T of 0.33 ms, and with the peak-to-peak value Vpp set variously at 1 kV, 1.5 kV, 2 kV, and 2.5 kV. The experiments were performed with various action periods ta wherein the AC field was utilized and rest periods ts wherein the AC field was not utilized by changing the time period during which the aforesaid pulse voltages were applied.

Figure 2:
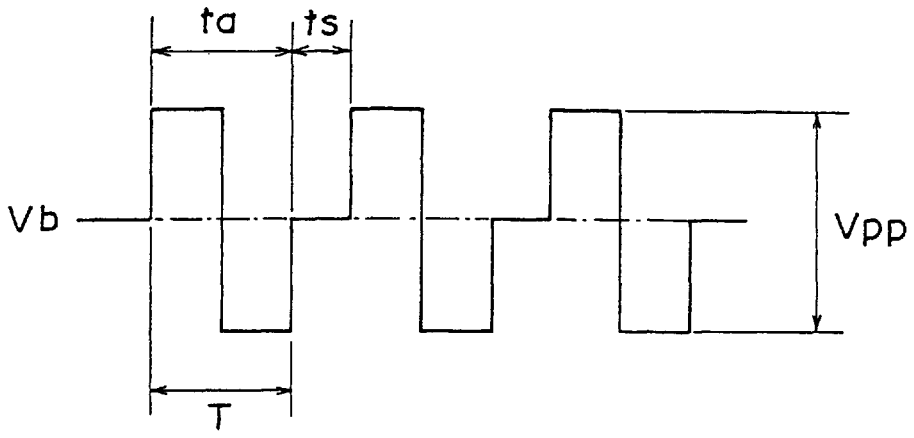
FIG. 2 illustrates the state of the alternating current (AC) voltage applied to the developer-carrying member from an AC power source in a first embodiment.

In this example, developing was accomplished by generating an AC electric field by supplying an AC voltage from the AC power source 15 to the developer-carrying member 11 such that in the action period ta the AC pulse voltage was active for only one period, i.e., 1 period T of 0.33 ms, and the rest period ts was set at 0.4 times said action period ta, as shown in FIG. 2, and the spacing Ds between the image-carrying member 1 and the developer-carrying member 11 in the developing region, the circumferential speed ratio θ of the developer-carrying member 11 relative to the image-carrying member 1, and the peak-to-peak value Vpp of the AC voltage were variously modified as described above. When the AC electric field was active as described above, the number N of rest periods ts per second was set at 2,143 times/second.

Based on the aforesaid developing conditions, the value of θ×(Vpp/Ds)×T×N=A was determined, and the texture of the obtained image was studied; results are shown in Table 1below. The occurrence of leaks which prevented development under the aforesaid developing conditions are indicated by "leak" in the aforesaid table.

The texture of the obtained images was evaluated by forming halftone images having a mean image density (ID) of 0.4, and measuring the image density of areas having a 10×100 μm surface area each 5 μm using a microdensitometer (model 2405; Abe Sekkei K.K.). The standard deviation in each halftone image was determined, and the dispersion of the image density was expressed as texture. The smaller the aforesaid value, the smaller the dispersion of image density, and the better texture.

TABLE 1

| Ds = 0.3 mm | | | | Ds = 0.5 mm | | | |
|---|---|---|---|---|---|---|---|
| θ | Vpp (kV) | A | Texture | θ | Vpp (kV) | A | Texture |
| 1 | 1.0 | $2.38\times10^3$ | 0.0505 | 1 | 1.0 | $1.43\times10^3$ | 0.0508 |
| 1 | 1.5 | $3.57\times10^3$ | 0.0497 | 1 | 1.5 | $2.14\times10^3$ | 0.0507 |
| 1 | 2.0 | $4.76\times10^3$ | leak | 1 | 2.0 | $2.86\times10^3$ | 0.0501 |
| 1 | 2.5 | $5.95\times10^3$ | leak | 1 | 2.5 | $3.57\times10^3$ | 0.0498 |
| 2 | 1.0 | $4.76\times10^3$ | 0.0495 | 2 | 1.0 | $2.86\times10^3$ | 0.0501 |
| 2 | 1.5 | $7.14\times10^3$ | 0.0489 | 2 | 1.5 | $4.29\times10^3$ | 0.0495 |
| 2 | 2.0 | $9.52\times10^3$ | leak | 2 | 2.0 | $5.71\times10^3$ | 0.0490 |
| 2 | 2.5 | $1.19\times10^4$ | leak | 2 | 2.5 | $7.14\times10^3$ | 0.0489 |
| 3 | 1.0 | $7.14\times10^3$ | 0.0490 | 3 | 1.0 | $4.29\times10^3$ | 0.0495 |

TABLE 1-continued

| Ds = 0.3 mm | | | | Ds = 0.5 mm | | | |
|---|---|---|---|---|---|---|---|
| θ | Vpp (kV) | A | Texture | θ | Vpp (kV) | A | Texture |
| 3 | 1.5 | $1.07 \times 10^4$ | 0.0488 | 3 | 1.5 | $6.43 \times 10^3$ | 0.0489 |
| 3 | 2.0 | $1.43 \times 10^4$ | leak | 3 | 2.0 | $8.57 \times 10^3$ | 0.0488 |
| 3 | 2.5 | $1.79 \times 10^4$ | leak | 3 | 2.5 | $1.07 \times 10^4$ | 0.0489 |

Images having excellent texture with minimal dispersion of image density were obtained when the texture value was small, i.e., in the vicinity of 0.0490, which was the case when the value A[=θ×(Vpp/Ds)×T×N] was equal to or greater than $5\times10^3$, and the value Vpp/Ds was equal to or less than 5 (i.e., when Vpp was 2.0 or less at Ds of 0.3 mm, and all cases when Ds was 0.5 mm).

EXAMPLE 2

Figure 3:
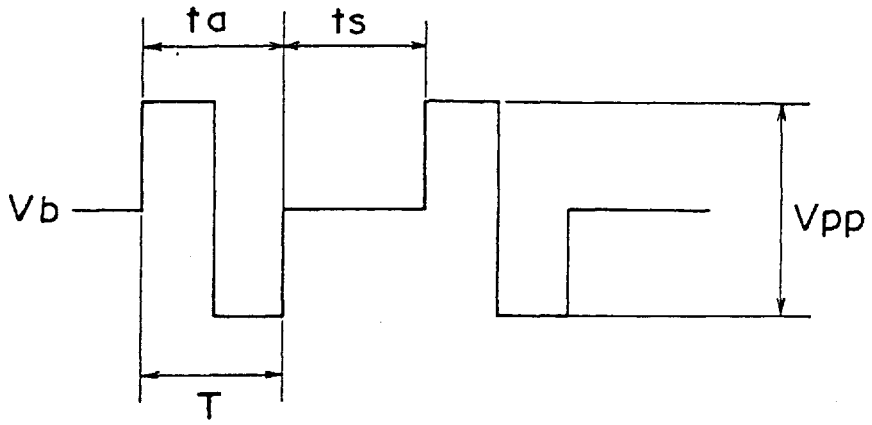
FIG. 3 illustrates the state of the alternating current (AC) voltage applied to the developer-carrying member from an AC power source in a second embodiment.

In example 2, developing was accomplished in the same manner as in example 1 with the exception that an AC voltage was supplied from the AC power source 15 to the developer-carrying member 11 such that in the action period the AC pulse voltage was active for only for 0.33 ms of one period T, and the rest period ts was set at the same time period as said action period ta, as shown in FIG. 3. When the AC electric field was active as described above, the number N of rest periods ts per second was set at 1,500 times/second.

In example 2, the value of A[=θ×(Vpp/Ds)×T×N] was determined based on the aforesaid developing conditions, and the texture of the obtained image was studied as in example 1. The results are shown in Table 2 below.

TABLE 2

| Ds = 0.3 mm | | | | Ds = 0.5 mm | | | |
|---|---|---|---|---|---|---|---|
| θ | Vpp (kV) | A | Texture | θ | Vpp (kV) | A | Texture |
| 1 | 1.0 | $1.67 \times 10^3$ | 0.0508 | 1 | 1.0 | $1.00 \times 10^3$ | 0.0509 |
| 1 | 1.5 | $2.50 \times 10^3$ | 0.0503 | 1 | 1.5 | $1.50 \times 10^3$ | 0.0508 |
| 1 | 2.0 | $3.33 \times 10^3$ | leak | 1 | 2.0 | $2.00 \times 10^3$ | 0.0508 |
| 1 | 2.5 | $4.17 \times 10^3$ | leak | 1 | 2.5 | $2.50 \times 10^3$ | 0.0504 |
| 2 | 1.0 | $3.33 \times 10^3$ | 0.0499 | 2 | 1.0 | $2.00 \times 10^3$ | 0.0507 |
| 2 | 1.5 | $5.00 \times 10^3$ | 0.0492 | 2 | 1.5 | $3.00 \times 10^3$ | 0.0501 |
| 2 | 2.0 | $6.67 \times 10^3$ | leak | 2 | 2.0 | $4.00 \times 10^3$ | 0.0495 |
| 2 | 2.5 | $8.33 \times 10^3$ | leak | 2 | 2.5 | $5.00 \times 10^3$ | 0.0493 |
| 3 | 1.0 | $5.00 \times 10^3$ | 0.0492 | 3 | 1.0 | $3.00 \times 10^3$ | 0.0502 |
| 3 | 1.5 | $7.50 \times 10^3$ | 0.0488 | 3 | 1.5 | $4.50 \times 10^3$ | 0.0495 |
| 3 | 2.0 | $1.00 \times 10^4$ | leak | 3 | 2.0 | $6.00 \times 10^3$ | 0.0489 |
| 3 | 2.5 | $1.25 \times 10^4$ | leak | 3 | 2.5 | $7.50 \times 10^3$ | 0.0488 |

Images having excellent texture with minimal dispersion of image density were obtained as in example 1 when the texture value was small, i.e., in the vicinity of 0.0490, which was the case when the value A[=θ×(Vpp/Ds)×T×N] was equal to or greater than $5\times10^3$, and the value Vpp/DS was equal to or less than 5.

EXAMPLE 3

Figure 4:
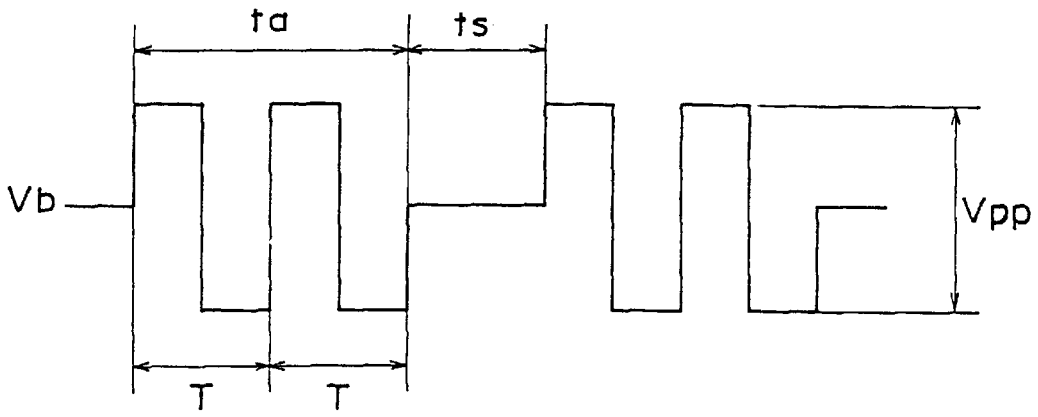
FIG. 4 illustrates the state of the alternating current (AC) voltage applied to the developer-carrying member from an AC power source in a third embodiment.

In example 3, developing was accomplished in the same manner as in example 1 with the exception that an AC voltage was supplied from the AC power source 15 to the developer-carrying member 11 such that in the action period ta the AC pulse voltage was active for 2 periods, i.e., the action period ta was double the period T of the AC pulse voltage, and the rest period ts was set at 0.5 times of said action period ta, i.e., at 1 cycle T of the AC voltage pulse, as shown in FIG. 4. When the AC electric field was active as described above, the number N of rest periods ts per second was set at 1,000 times/second.

In example 3, the value of A[=θ×(Vpp/Ds)×T×N] was determined based on the aforesaid developing conditions, and the texture of the obtained image was studied as in example 1. The results are shown in Table 3 below.

TABLE 3

| Ds = 0.3 mm | | | | Ds = 0.5 mm | | | |
|---|---|---|---|---|---|---|---|
| θ | Vpp (kV) | A | Texture | θ | Vpp (kV) | A | Texture |
| 1 | 1.0 | $1.11 \times 10^3$ | 0.0509 | 1 | 1.0 | $6.67 \times 10^2$ | 0.0511 |
| 1 | 1.5 | $1.67 \times 10^3$ | 0.0508 | 1 | 1.5 | $1.00 \times 10^3$ | 0.0509 |
| 1 | 2.0 | $2.22 \times 10^3$ | leak | 1 | 2.0 | $1.33 \times 10^3$ | 0.0509 |
| 1 | 2.5 | $2.78 \times 10^3$ | leak | 1 | 2.5 | $1.67 \times 10^3$ | 0.0509 |
| 2 | 1.0 | $2.22 \times 10^3$ | 0.0505 | 2 | 1.0 | $1.33 \times 10^3$ | 0.0510 |
| 2 | 1.5 | $3.33 \times 10^3$ | 0.0500 | 2 | 1.5 | $2.00 \times 10^3$ | 0.0508 |
| 2 | 2.0 | $4.44 \times 10^3$ | leak | 2 | 2.0 | $2.67 \times 10^3$ | 0.0503 |
| 2 | 2.5 | $5.56 \times 10^3$ | leak | 2 | 2.5 | $3.33 \times 10^3$ | 0.0498 |
| 3 | 1.0 | $3.33 \times 10^3$ | 0.0498 | 3 | 1.0 | $2.00 \times 10^3$ | 0.0504 |
| 3 | 1.5 | $5.00 \times 10^3$ | 0.0493 | 3 | 1.5 | $3.00 \times 10^3$ | 0.0500 |
| 3 | 2.0 | $6.67 \times 10^3$ | leak | 3 | 2.0 | $4.00 \times 10^3$ | 0.0495 |
| 3 | 2.5 | $8.33 \times 10^3$ | leak | 3 | 2.5 | $5.00 \times 10^3$ | 0.0491 |

Images having excellent texture with minimal dispersion of image density were obtained as in example 1 when the texture value was small, i.e., in the vicinity of 0.0490, which was the case when the value A[=θ×(Vpp/Ds)×T×N] was equal to or greater than $5\times10^3$, and the value Vpp/Ds was equal to or less than 5.

EXAMPLE 4

Figure 5:
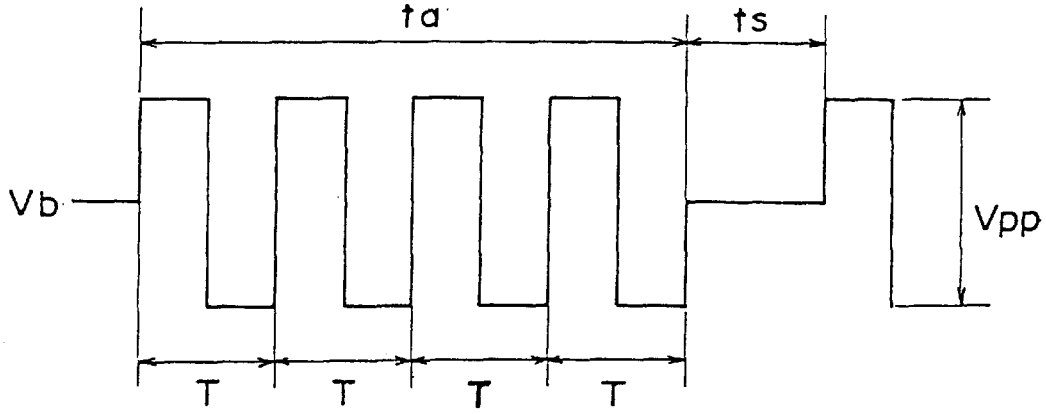
FIG. 5 illustrates the state of the alternating current (AC) voltage applied to the developer-carrying member from an AC power source in a fourth embodiment.
Figure 6:
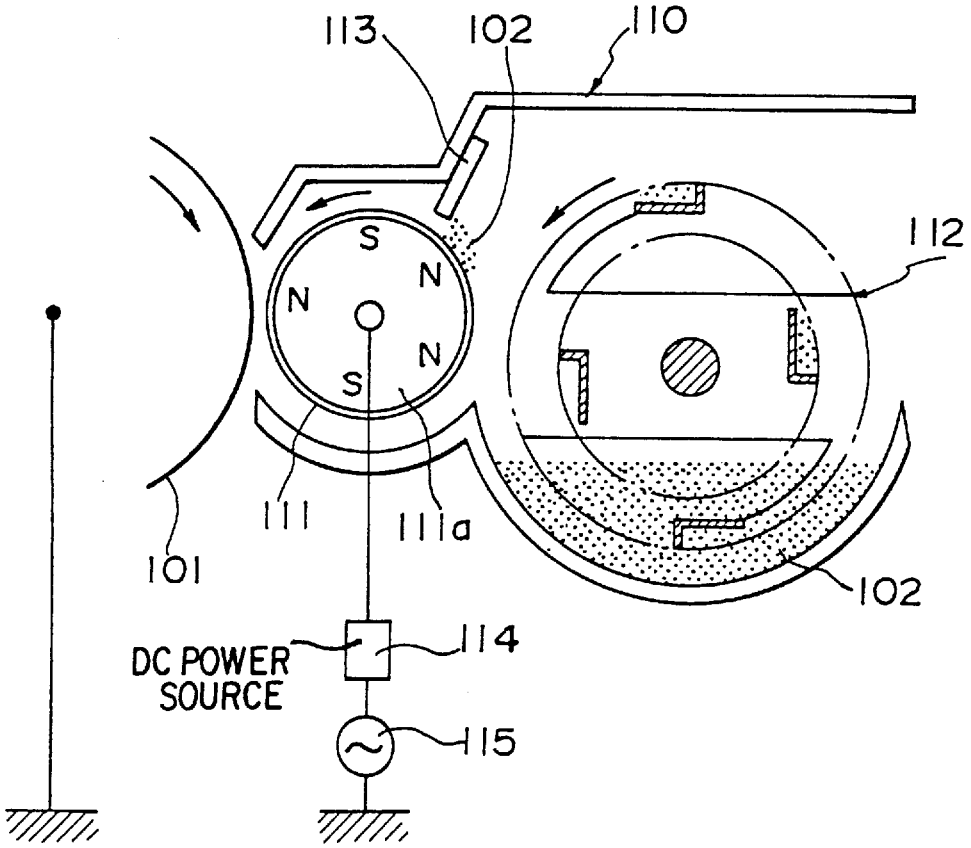
FIG. 6 briefly shows the construction of a conventional developing device.

In example 4, developing was accomplished in the same manner as in example 1 with the exception that an AC voltage was supplied from the AC power source 15 to the developer-carrying member 11 such that in the action period ta the AC pulse voltage was active for 4 cycles, i.e., the action period ta was four times the period T of the AC pulse voltage, and the rest period ts was set at ¼ of said action period ta, i.e., at 1 cycle T of the AC voltage pulse, as shown in FIG. 5. When the AC electric field was active as described above, the number N of rest periods ts per second was set at 600 times/second.

In example 4, the value of A[=θ×(Vpp/Ds)×T×N] was determined based on the aforesaid developing conditions, and the texture of the obtained image was studied as in example 1. The results are shown in Table 4 below.

TABLE 4

| Ds = 0.3 mm | | | | Ds = 0.5 mm | | | |
|---|---|---|---|---|---|---|---|
| θ | Vpp (kV) | A | Texture | θ | Vpp (kV) | A | Texture |
| 1 | 1.0 | $6.67 \times 10^2$ | 0.0511 | 1 | 1.0 | $4.00 \times 10^2$ | 0.0511 |
| 1 | 1.5 | $1.00 \times 10^3$ | 0.0510 | 1 | 1.5 | $6.00 \times 10^2$ | 0.0510 |
| 1 | 2.0 | $1.33 \times 10^3$ | leak | 1 | 2.0 | $8.00 \times 10^2$ | 0.0511 |
| 1 | 2.5 | $1.67 \times 10^3$ | leak | 1 | 2.5 | $1.00 \times 10^3$ | 0.0509 |
| 2 | 1.0 | $1.33 \times 10^3$ | 0.0509 | 2 | 1.0 | $8.00 \times 10^2$ | 0.0510 |
| 2 | 1.5 | $2.00 \times 10^3$ | 0.0508 | 2 | 1.5 | $1.20 \times 10^3$ | 0.0508 |
| 2 | 2.0 | $2.67 \times 10^3$ | leak | 2 | 2.0 | $1.60 \times 10^3$ | 0.0508 |
| 2 | 2.5 | $3.33 \times 10^3$ | leak | 2 | 2.5 | $2.00 \times 10^3$ | 0.0507 |
| 3 | 1.0 | $2.00 \times 10^3$ | 0.0507 | 3 | 1.0 | $1.20 \times 10^3$ | 0.0509 |

TABLE 4-continued

| Ds = 0.3 mm | | | | Ds = 0.5 mm | | | |
|---|---|---|---|---|---|---|---|
| θ | Vpp (kV) | A | Texture | θ | Vpp (kV) | A | Texture |
| 3 | 1.5 | $3.00 \times 10^3$ | 0.0502 | 3 | 1.5 | $1.80 \times 10^3$ | 0.0509 |
| 3 | 2.0 | $4.00 \times 10^3$ | leak | 3 | 2.0 | $2.40 \times 10^3$ | 0.0504 |
| 3 | 2.5 | $5.00 \times 10^3$ | leak | 3 | 2.5 | $3.00 \times 10^4$ | 0.0502 |

In example 4, leaks occurred when the value of A=[θ×(Vpp/Ds)×T×N] was greater than $5\times10^3$ with Ds set at 0.3 mm. When the value of A was less than $5\times10^{3}$, the texture value was invariable above 0.0495 and pronounced dispersion of image density precluded obtaining image with excellent texture.

Developing was also accomplished using an AC voltage was supplied from the AC power source 15 to the developer-carrying member 11 such that in the action period ta the AC pulse voltage was active for 8 cycles, i.e., the action period ta was eight times the period T of the AC pulse voltage, and the rest period ts was set at ⅛ of said action period ta, i.e., at 1 cycle T of the AC voltage pulse, and developing was also accomplished using an AC voltage was supplied from the AC power source 15 to the developer-carrying member 11 such that in the action period ta the AC pulse voltage was active for 16 cycles, i.e., the action period ta was sixteen times the period T of the AC pulse voltage, and the rest period ts was set at 1/16 of said action period ta, i.e., at 1 cycle T of the AC voltage pulse. In these instances, the value of A was less than $5\times10^3$, the texture value was invariable above 0.0495 and pronounced dispersion of image density precluded obtaining image with excellent texture.

EXAMPLE 5

In example 5, experiments were conducted with the spacing Ds between the image-carrying member 1 and the developer-carrying member 11 in the developing region set at 0.3 mm, and the circumferential speed ratio θ of the developer-carrying member 11 relative to the image-carrying member 1 set at 2, and the peak-to-peak voltage value Vpp of the AC pulse voltage supplied from the AC power source 15 to the developer-carrying member 11 set at 1.5 kV. The AC voltage supplied to the developer-carrying member 11 from the AC power source 15 was an AC pulse voltage had a frequency of 3 kHz and a period T of 0.33 ms. In the action period ta wherein an AC field was generated by supplying the aforesaid AC pulse voltage, the AC pulse voltage was active only for one cycle T of 0.33 ms, as in examples 1 and 2, but the rest period ts following said action period ta was variously modified, such that developing was accomplished with the values ts/ta shown in Table 5. In example 5, the value of A[=θ×(Vpp/Ds)×T×N] was determined based on the aforesaid developing conditions, and the texture of the obtained image was studied as in example 1. The results are shown in Table 5 below.

TABLE 5

| ts/ta | 1.00 | 0.50 | 0.40 | 0.33 | 0.25 | 0.13 |
|---|---|---|---|---|---|---|
| $A \times 10^3$ | 5.00 | 6.67 | 7.14 | 7.50 | 8.00 | 8.85 |
| Texture | 0.0492 | 0.0489 | 0.0489 | 0.0488 | 0.0488 | 0.0489 |

When the value A=[θ×(Vpp/Ds)×T×N] was greater than $5\times10^3$, and the AC pulse voltage was active only one cycle in action period ta and the rest period ts was shorter than said action period ta, i.e., when the AC pulse voltage was active for an action period ta of only 1 cycle T which was longer than the rest period ts, the texture value was small, and images were obtain which had excellent texture with extremely small dispersion of image density.

In the developing device of the present embodiments, developing is accomplished by alternatingly repeating an action period wherein an AC field is generated between an image-carrying member and a developer-carrying member and a rest period wherein said AC field is not active, and when the circumferential speed ratio of the developer-carrying member 11 relative to the image-carrying member 1 is designated θ, the spacing between the image-carrying member 1 and the developer-carrying member 11 in the developing region is designated DS (mm), the peak-to-peak voltage of the AC voltage applied to the developer-carrying member 11 is designated Vpp (kV), the period of the AC voltage is designated T (ms), and the number of rest periods per second is designated N (number periods per second), developing is accomplished so as to satisfy the following conditions: $5\times10^3 \leqq \theta\times(Vpp/Ds)\times T\times N$, and $5 \geqq Vpp/Ds$. Therefore, toner is thoroughly dispersed in a broad range in the developing region so as to assure suitable image density and excellent reproducibility of halftone images, and produce images having excellent texture.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A developing device for developing electrostatic latent image formed on a rotatable image-carrying member, said developing device comprising:

a rotatable developer-carrying member disposed opposite said image-carrying member, wherein developer is transported via the rotation of said developer-carrying member to a developing region at which said developer carrying member confronts said image-carrying member; and a voltage supplying unit which supplies an alternating current voltage to said developer-carrying member so as to alternately repeat an action period wherein an alternating current field is active between said developer-carrying member and said image-carrying member and a rest period wherein an alternating current field is not active;

wherein the following conditions are satisfied:

$$5\times10^3 \leqq \theta\times(Vpp/Ds)\times T\times N$$

and $5 \geqq Vpp/Ds$ where θ represents the circumferential speed ratio of the developer-carrying member relative to the image-carrying member;

Ds (mm) represents a space between the developer-carrying member and the image-carrying member in the developing region;

Vpp (kV) represents a peak-to-peak value of an AC voltage supplied to the developer-carrying member;

T (ms) represents a cycle of the alternating current voltage; and

N (revolutions per second) represents a number of rest periods of the alternating current voltage per second.

2. A developing device as claimed in claim 1, wherein said voltage supplying unit supplies the alternating current voltage to said developer-carrying member so that the alternating current voltage is active only one cycle in an action period and the rest period is same as or shorter than the action period.

3. A developing device as claimed in claim 1, wherein an amount of developer transported to the developing region by said developer-carrying member is 0.5–10 mg/cm$^2$.

4. A developing device as claimed in claim 3, wherein the amount of developer transported to the developing region by said developer-carrying member is 1–7 mg/cm$^2$.

5. A developing device as claimed in claim 1, wherein said developer is a two-component developer comprising a carrier and a toner.

6. A developing device as claimed in claim 5, wherein said carrier has a volume-average particle size of 20–50 $\mu$m.

7. A developing device as claimed in claim 6, wherein said carrier has a volume-average particle size of 25–45 $\mu$m.

8. A developing device as claimed in claim 5, wherein said carrier is a binder type carrier comprising fine magnetic powder dispersed in a binder resin.

9. A developing device as claimed in claim 5, wherein said carrier is a coated type carrier comprising magnetic particles the having surfaces coated with resin.

10. A developing device as claimed in claim 5, wherein said toner has a volume-average particle size of 3–12 $\mu$m.

11. A developing device as claimed in claim 10, wherein said toner has a volume-average particle size of 4–9 $\mu$m.

12. A developing device as claimed in claim 5, wherein a weight ratio of the toner and carrier mixture in said developer is in a range of 8–25 percent-by-weight.

13. A developing device as claimed in claim 12, wherein a weight ratio of the toner and carrier mixture in said developer is in a range of 10–20 percent-by-weight.

14. A method of developing electrostatic latent image formed on a rotatable image-carrying member by using a developing device including a rotatable developer-carrying member disposed opposite said image-carrying member, wherein developer is transported via a rotation of said developer-carrying member to a developing region at which said developer carrying member confronts said image-carrying member, said method comprising the steps of:

1) supplying an alternating current voltage to said developer-carrying member so as to alternately repeat an action period wherein an alternating current field is active between said developer-carrying member and said image-carrying member and a rest period wherein an alternating current field is not active; and 2) satisfying the following conditions:

$$5\times10^3 \leqq \theta\times(Vpp/Ds)\times T\times N$$

and $5 \geqq Vpp/Ds$ where θ represents a circumferential speed ratio of the developer-carrying member relative to the image-carrying member;

Ds (mm) represents a space between the developer-carrying member and the image-carrying member in the developing region;

Vpp (kV) represents a peak-to-peak value of an AC voltage supplied to the developer-carrying member;

T (ms) represents a cycle of the alternating current voltage; and

N (revolutions per second) represents a number of rest periods of the alternating current voltage per second.

15. A method as claimed in claim 14, wherein at said step 1) the alternating current voltage is supplied to said developer-carrying member so that the alternating current voltage is active one cycle in an action period and the rest period is same as or shorter than the action period.

* * * * *